US008679586B2

(12) United States Patent
Czika et al.

(10) Patent No.: US 8,679,586 B2
(45) Date of Patent: Mar. 25, 2014

(54) SUCCESSIVE CORROSION-PROTECTING PRE-TREATMENT OF METAL SURFACES IN A MULTIPLE-STEP PROCESS

(75) Inventors: Franz-Adolf Czika, Neuss (DE); Sophie Cornen, Duesseldorf (DE); Jens Kroemer, Duesseldorf (DE); Michael Frank, Neuss (DE); Nicole Teubert, Herne (DE); Jan-Willem Brouwer, Willich (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 488 days.

(21) Appl. No.: 13/017,241

(22) Filed: Jan. 31, 2011

(65) Prior Publication Data

US 2011/0189401 A1 Aug. 4, 2011

Related U.S. Application Data

(63) Continuation of application No. PCT/EP2009/060063, filed on Aug. 4, 2009.

(30) Foreign Application Priority Data

Aug. 12, 2008 (DE) ..... 10 2008 038 653

(51) Int. Cl.

| | |
|---|---|
| ***C23C 22/06*** | (2006.01) |
| ***C23C 22/34*** | (2006.01) |
| ***C23C 22/36*** | (2006.01) |
| ***C23C 22/77*** | (2006.01) |
| ***C23C 22/78*** | (2006.01) |
| ***C23C 22/80*** | (2006.01) |

(52) U.S. Cl.

CPC ..... *C23C 22/361* (2013.01); *C23C 22/77* (2013.01); *C23C 22/78* (2013.01); *C23C 22/80* (2013.01); *C23C 22/06* (2013.01)

USPC ..... 427/327; 427/328; 427/299; 427/331; 148/243; 148/247; 148/320

(58) Field of Classification Search

USPC ..... 427/327, 299, 331; 148/243, 247, 320

See application file for complete search history.

(56) References Cited

U.S. PATENT DOCUMENTS

| | | | | |
|---|---|---|---|---|
| 2,874,081 | A * | 2/1959 | Cavanagh et al. | 148/254 |
| 4,130,446 | A * | 12/1978 | Murakami et al. | 148/262 |
| 5,259,960 | A * | 11/1993 | Beck et al. | 210/638 |
| 2003/0168128 | A1 * | 9/2003 | Cole et al. | 148/269 |
| 2005/0167005 | A1 * | 8/2005 | Barnard et al. | 148/275 |

FOREIGN PATENT DOCUMENTS

| | | | |
|---|---|---|---|
| CH | 270548 | A | 12/1950 |
| DE | 1112868 | A | 8/1961 |
| DE | 19854431 | A1 | 5/2000 |
| DE | 102005007752 | A1 | 8/2000 |
| DE | 19933189 | A1 | 1/2001 |
| DE | 10236293 | A1 | 10/2003 |
| DE | 10256884 | A1 | 6/2004 |
| DE | 10110834 | B4 | 3/2005 |
| DE | 10323305 | B4 | 3/2006 |
| DE | 102005059314 | A1 | 6/2007 |
| DE | 102007006450 | A1 | 8/2008 |
| EP | 17302 | A1 * | 10/1980 |
| GB | 1540308 | A * | 2/1979 |
| GB | 2058846 | A * | 4/1981 |
| WO | 2004101850 | A1 | 11/2004 |

OTHER PUBLICATIONS

C. Stromberg et al, "Synthesis and characterisation of surface gradient thin conversion films on zinc coated steel", Electrochimica Acta 52, (2006), p. 804-815.

International Search Report for International Application PCT/EP2009/060063 mailed Nov. 5, 2009. All references cited in the International Search Report are listed above.

German Proceeding for priority application DE 10 2008 038 653.7-45 dated Jun. 26, 2009. All references cited in the German Proceeding are listed above.

* cited by examiner

*Primary Examiner* — David Turocy

(74) *Attorney, Agent, or Firm* — Mary K. Cameron

(57) ABSTRACT

The present invention relates to a method for improving the corrosion-protecting pre-treatment of metal surfaces and using rinse water in a manner to conserve resources in such a corrosion-protecting pre-treatment, comprising a conversion treatment step using an aqueous composition comprising at least 50 ppm of the elements B, Si, Ti, Zr and/or Hf in the form of water-soluble compounds at a pH value of 3 to 5.5, wherein a minimum fraction of 10 ppm of the elements B, Si, Ti, Zr and/or Hf in the form of water-soluble compounds is present in the last pre-rinse step and a portion of the aqueous composition of the conversion treatment step is contained in the first post-rinse step. The resource-conserving use of the rinse water is accomplished according to the invention by way of a cascaded return of rinse water from the last rinse step to the first rinse step. The present invention also relates to a metallic component treated using the method according to the invention and to the use thereof in a process for applying a multi-coating system, in particular a paint system containing an organic binder, in industrial manufacturing.

17 Claims, No Drawings

SUCCESSIVE CORROSION-PROTECTING PRE-TREATMENT OF METAL SURFACES IN A MULTIPLE-STEP PROCESS

CROSS-REFERENCE TO RELATED CASES

This application is a continuation under 35 U.S.C. Sections 365(c) and 120 of International Application No. PCT/EP2009/060063, filed Aug. 4, 2009 and published on Feb. 18, 2010 as WO 2010/018102, which claims priority from German Patent Application Serial No. 10 2008 038 653.7 filed Aug. 12, 2008, which are incorporated herein by reference in their entirety.

The present invention relates to a method for improving the anticorrosion pretreatment of metal surfaces and to the resource-conserving use of rinsing water in such an anticorrosion pretreatment encompassing a conversion treatment stage with an aqueous composition containing at least 50 ppm of the elements B, Si, Ti, Zr and/or Hf in the form of water-soluble compounds at a pH value of 3 to 5.5, wherein a minimum proportion of 10 ppm of the elements B, Si, Ti, Zr and/or Hf in the form of water-soluble compounds is achieved in the prerinsing stage immediately before the actual conversion treatment and part of the aqueous composition of the conversion treatment stage is contained in the first postrinsing stage. The resource-conserving use of the rinsing water is achieved according to the invention by means of a cascading recirculation of rinsing water from the final rinsing stage to the first rinsing stage. Furthermore, the present invention comprises a metallic component that has been treated according to such a method and the use thereof in a process for applying a multilayer system, in particular a paint system containing an organic binder, in industrial manufacture. Such a metallic component is also suitable for the production of white goods, electronic housings, in the fields of construction and architecture, and for the production of vehicle bodies in automotive manufacture.

Anticorrosive agents which represent an acidic aqueous solution of water-soluble compounds of the elements B, Si, Ti, Zr and/or Hf in the form of water-soluble compounds, in particular in the form of fluoro complexes, have been known for a long time. They are increasingly being used as a replacement for chromating processes, which are being used less and less because of the toxicological properties of chromium compounds. These solutions of water-soluble compounds of the elements B, Si, Ti, Zr and/or Hf generally contain other active anticorrosive substances which further improve the anticorrosion action and paint adhesion.

In the automotive manufacturing sector which is particularly relevant to the present invention, various metallic materials are increasingly being used and assembled into composite structures. In vehicle body construction, predominantly steels of various types continue to be used owing to their specific material properties, but also to an increasing extent light metals which are particularly important for a considerable reduction in weight of the overall body. To take account of this development, it is essential to develop methods for the application of these chromium-free pretreatment solutions especially for vehicle body protection, or to develop existing methods further.

One conventional processing sequence in anticorrosion pretreatment consists in the cleaning and degreasing of the metallic surfaces, followed by one or more rinsing stages with different water quality before the actual conversion treatment takes place. This in turn is followed by one or more rinsing stages to remove constituents of the conversion treatment solution which are adhering to the components. After the final rinsing step, which is in principle supplied with deionized water ($\kappa<5\ \mu Scm^{-1}$), coating with the organic binder system takes place, which is typically electrophoretic painting.

These methods always place emphasis on a resource-conserving handling of both the pretreatment solution and the rinsing water which is needed to remove soluble residues of the pretreatment solution from the treated surface, at the same time as high quality requirements regarding the anticorrosion pretreatment. The cleaning of the metallic components with rinsing water is essential particularly for the subsequent coating with the organic binder system. The organic binder systems tolerate only small quantities of extraneous ions which are introduced into the coating bath with the component by drag-over. For example, for optimum performance of the organic first coat in automotive manufacture it is required that the conductivity in the final rinsing step before electrophoretic painting should not exceed a value of 30 $\mu Scm^{-1}$. This requires the continuous supply of deionized water into the rinsing stages of the pretreatment, there being an economic and ecological interest in minimizing this supply and at the same time bringing the associated risks under control for the plant to be in constant working order and to guarantee uniform high quality of the anticorrosion conversion treatment.

Various strategies for rinsing water management are known to the person skilled in the art in the field of anticorrosion phosphating, which relate on the one hand to conserving deionized water and on the other hand to recovering reusable materials from proportions of the phosphating solution dragged over into the rinsing stages.

The German patent application 198 54 431 describes a method for conserving rinsing water during phosphating. Here, the phosphating bath overflow and/or the rinsing water is subjected to a recovery method such as e.g. reverse osmosis, an ion exchange method, nanofiltration, electrodialysis and/or heavy metal precipitation after the phosphating, and the aqueous phase depleted in metal ions here is used as rinsing water in each case for rinsing the metal parts to be phosphated after they have been cleaned.

The German patent application 102 36 293 sets itself the object of returning active substances from phosphating which have passed into the cleaning solution and/or into the first rinsing water to the phosphating solution. By means of appropriate process control, further conservation of rinsing water should preferably also be possible so that the phosphating process can be operated with practically no waster water.

The recovery of deionized rinsing water from which heavy metal ions have been removed for rinsing water systems with cascaded recirculation of rinsing water from the final rinsing stage into the first rinsing stage is also described in the German application 102 56 884. In the recirculation of rinsing water, however, the active components of the phosphating solution are ultimately removed from the rinsing water and at least partly returned to the phosphating solution again.

The prior art therefore contains numerous proposals for conserving rinsing water and for recirculating reusable materials from the rinsing water into the phosphating solution after phosphating. However, as a result of general drag-over during practical operation and in particular of the cascade-type transfer of rinsing water from subsequent rinsing stages into upstream rinsing stages and as far as into the cleaning solution, active substances from the conversion treatment solution pass into the first rinsing water or the cleaning solution.

With regard to non-crystalline conversion coat formation, for example in chromium-free treatment solutions based on water-soluble compounds of the elements B, Si, Ti, Zr and/or Hf, methods of this type with cascaded recirculation of rinsing water have been neither tested nor investigated in terms of the influence of active components in the rinsing water on the quality of the coating. However, it is known from the scientific publication by Stromberg et al. in Electrochimica Acta 52 (2006) 804-815 that, while it is true that the coat weights increase with the treatment period during the treatment of galvanized steel surfaces with acidic aqueous solutions of $H_2ZrF_6$, at the same time, however, an optimum treatment period for corrosion protection results, with additional exposure of the metal surface beyond the optimum time period apparently leading to excessive etching of the surface and thus to reduced protection from corrosion. For a well-adjusted pretreatment method with aqueous compositions based on water-soluble compounds of the elements B, Si, Ti, Zr and/or Hf, therefore, the presence of active components of precisely these conversion treatment solutions in the rinsing stages appears disadvantageous.

Consequently, the German application 10 2007 006 450 presents a method precisely for the separation of active components from the rinsing water of an anticorrosion pretreatment, in which water-soluble fluoro complexes of zirconium are removed from the rinsing water by means of precipitation with a milk of lime solution and the rinsing water from which active components have thus been removed is returned to the rinsing water system.

The object of the present invention now consists in improving the anticorrosion action of an aqueous pretreatment containing the elements B, Si, Ti, Zr and/or Hf in the form of water-soluble compounds at a pH value of 3 to 5.5 in a processing sequence for pretreatment, and at the same time establishing a method that conserves resources as far as possible.

Surprisingly, it has been found that in a method for the anticorrosion pretreatment of metal surfaces comprising a conversion treatment stage (D) with an aqueous composition (1) containing in total at least 50 ppm of the elements B, Si, Ti, Zr and/or Hf in the form of water-soluble compounds at a pH value of 3 to 5.5 an improved corrosion protection is achieved if the metallic surface passes in succession through at least the following treatment stages:

(C) prerinsing with water containing in total at least 10 ppm of the elements B, Si, Ti, Zr and/or Hf in the form of water-soluble compounds
(D) conversion treatment with the aqueous composition (1)
(E) postrinsing with water containing part of the aqueous composition (1) of treatment stage (D)

Moreover, in a preferred processing sequence which additionally guarantees minimized use of rinsing water, the method according to the invention can be carried out by cascading the rinsing water from the final rinsing stage back into the first rinsing stage, wherein as a result of the drag-over of parts of the aqueous composition (1) into the subsequent rinsing stages with simultaneous cascade-type recirculation of rinsing water into the prerinsing stages, a stationary state is established with regard to the concentration of the active components in the post- and prerinsing stages. This cascading should be set up such that, in the stationary state, the concentration according to the invention of active components of no less than 10 ppm of the elements B, Si, Ti, Zr and/or Hf in the form of water-soluble compounds is achieved in the prerinsing stage (C).

In a preferred embodiment, the present invention therefore comprises a method for the anticorrosion pretreatment of metal surfaces in a processing sequence comprising a conversion treatment stage (D) with an aqueous composition (1) containing in total at least 50 ppm of the elements B, Si, Ti, Zr and/or Hf in the form of water-soluble compounds at a pH value of 3 to 5.5, wherein the metallic surface passes in succession through the following treatment stages:

(A) optionally degreasing and cleaning
(B) optionally rinsing with process water optionally containing part of the aqueous composition of the degreasing and cleaning stage (A)
(C) prerinsing with water containing in total at least 10 ppm of the elements B, Si, Ti, Zr and/or Hf in the form of water-soluble compounds and optionally part of the aqueous composition of rinsing stage (B)
(D) conversion treatment with the aqueous composition (1) containing part of the aqueous composition of prerinsing stage (C)
(E) first postrinsing with water containing part of the aqueous composition of treatment stage (D)
(F) optionally second postrinsing with water containing part of the aqueous composition of postrinsing stage (E), wherein the final rinsing stage is supplied with deionized water and a cascaded recirculation of aqueous medium from the final rinsing stage to the first rinsing stage proceeds such that in total at least 10 ppm of the elements B, Si, Ti, Zr and/or Hf in the form of water-soluble compounds are present in the prerinsing stage (C), the treatment stage (D) being excepted from the cascaded recirculation and aqueous medium not being fed indirectly and directly into the treatment stage (D) from the final rinsing stage.

Metallic surfaces within the meaning of the present invention are surfaces of zinc, galvanized and alloy-galvanized steel, aluminum and alloys thereof as well as steel or iron. For these metallic surfaces or metallic components which are assembled from these materials, effective corrosion protection can be achieved with minimal consumption of rinsing water. For steel and iron surfaces in particular, in the processing sequence according to the invention a significantly improved corrosion protection results compared with a method without cascading of the rinsing water. In the method according to the invention, therefore, in particular those metal surfaces or assembled metallic components are preferred which are or comprise, at least in part, surfaces of steel and/or iron, particularly preferably those which are or comprise exclusively surfaces of steel and/or iron.

The processing sequence associated with the method according to the invention, which consists in passing the metallic component to be treated in succession through at least the treatment stages (C), (D) and (E), causes part of the aqueous composition of the respective treatment stage to be dragged over into the following treatment stage in each case. This so-called drag-over is based on the fact that the film of liquid adhering to the treated metallic component passes into the following treatment stage in each case. This transfer of adhering aqueous medium into the next treatment stage in each case may vary, however, as a function of the shape and nature of the components to be treated. For example, car bodies additionally have complex geometries which tend to drag over more treatment solution than is the case purely with adhering water. In general, the person skilled in the art who is in charge of such a process chain and monitors the respective bath parameters talks about strongly and weakly scooping components. A typical value for drag-over for the pretreatment of car bodies is approx. 100 ml of aqueous medium per $m^2$ of the treated component.

The performance of the preferred method according to the invention with cascading recirculation of the rinsing water is therefore guaranteed by a continuous operation of said method in which the respective proportions of the aqueous composition of the previous treatment stage are dragged over into the following one in each case. It is of course also possible for the baths of the treatment stages to be prepared once in accordance with the method according to the invention, so that right from the start-up of a process chain for anticorrosion pretreatment and during the treatment of a first series of metallic components, the technical conditions corresponding to the method according to the invention are present.

Likewise, the treatment of a first series of metallic components in a processing sequence and during processing as in the method according to the invention can initially be utilized to drag over the respective aqueous compositions of the treatment stages during cascading recirculation of the rinsing water until all the technical parameters of the method according to the invention are met with respect to the compositions of the treatment stages. Such a first series of pretreated components will have poorer corrosion protection, in particular on steel and/or iron surfaces, as long as the required composition of treatment stage (C) of the method according to the invention is not yet reached. In principle, it is advantageous for the performance of the method according to the invention if the minimum concentration of active components in the prerinsing (C) is already preset before the treatment of a first series of components in a cascading operation, without drag-over by treated metallic components, by means of continuous addition of an appropriate quantity of water-soluble compounds of the elements B, Si, Ti, Zr and/or Hf either to the final prerinsing stage (C) and first postrinsing stage (E) or exclusively to the first postrinsing stage (E). In the operation according to the invention, only the proportion of the active components in prerinsing stage (C) then has to be monitored and if necessary carried out by adjusting the addition of a composition corresponding to conversion treatment stage (D) as described above. As a rule, however, owing to the drag-over of conversion treatment solution that additionally occurs, the concentration according to the invention of active components is reached in rinsing stage (C).

The term treatment stage according to the present invention is to be understood in the broadest sense as a process stage for the application of an aqueous composition on to a metallic component for a defined technical purpose. While in treatment stage (D) the conventional conversion treatment takes place, containing as active components water-soluble compounds of the elements B, Si, Ti, Zr and/or Hf, the purpose of the upstream treatment stages is the degreasing and cleaning of the components and the removal of residues from the cleaning stage and a preparatory treatment in the prerinsing (C) for the conventional conversion treatment (D). The same applies to the treatment stages downstream of the conventional conversion treatment, which bring about a follow-up treatment in the first postrinsing (E) and at the same time remove residues from the conversion treatment from the metal surface.

In the respective treatment stages, application in a dipping or spraying process is preferred, each treatment stage independently of one another being able to comprise one of these two forms of application. In particular, however, a method according to the invention is preferred in which the metallic component is brought into contact with the respective aqueous compositions in a dipping method in all the treatment stages.

The cascading recirculation of aqueous medium from the final rinsing stage into the first rinsing stage performed in the preferred method according to the invention contains the discharge of part of the aqueous medium from the respective treatment stage into the upstream treatment stage in each case according to the processing sequence, the treatment stage (D) containing the composition (1) for a conventional conversion treatment being excepted from the cascading, however. According to the invention, therefore, the cascading relates only to rinsing water with differing composition and function. No rinsing water is actively fed into treatment stage (D), therefore. An optional discharge of aqueous composition (1) from treatment stage (D) into prerinsing stage (C) serves only to adjust and maintain the concentration of the active components according to the invention in the prerinsing stage, in particular during start-up of the method according to the invention. In contrast to the unavoidable drag-over of portions of liquid according to the processing sequence (A) to (F), cascading is a special technical measure for the active recirculation of volumes from the postrinsing stages into the prerinsing stages, i.e. opposite to the processing sequence according to the invention.

For the method according to the invention, a cascaded recirculation of aqueous medium from the final rinsing stage to the first rinsing stage is preferred which proceeds continuously and in particular at a constant volumetric flow rate.

The rinsing water recirculated by the cascading, which accumulates in the first rinsing stage, can preferably either be again discharged into the waste water system by installing an overflow or recovered from the overflow by means of upstream ultrafiltration and subsequent ion exchange methods and/or reverse osmosis and returned into the final rinsing stage, so that in this case there is a closed rinsing water circuit.

One advantage of the preferred method according to the invention therefore lies in the fact that, owing to the cascading recirculation of rinsing water from the final rinsing stage into the first rinsing stage, less waste water from the individual treatment stages for the treatment of metal surfaces has to be discharged and accordingly less fresh water has to be supplied. This conserves resources and increases economic efficiency.

According to the present invention, it is also surprisingly shown that a content of conversion treatment solution which accumulates primarily in the first postrinsing stage (E) and the prerinsing stage (C) as a result of drag-over and cascaded recirculation has an advantageous effect on the formation of the conversion coating, so that both the anticorrosive effect and the paint adhesion, in particular on steel and/or iron surfaces, are significantly improved.

It is preferred for this purpose that in the method according to the invention, in total at least 20 ppm, preferably at least 50 ppm of the elements B, Si, Ti, Zr and/or Hf in the form of water-soluble compounds are contained in the prerinsing stage (C). As already mentioned above, this can be achieved by appropriately adjusting the cascaded recirculation of rinsing water with the simultaneous presence of drag-over of parts of the conversion treatment solution into the postrinsing stages. If the content of elements B, Si, Ti, Zr and/or Hf in the form of water-soluble compounds is less than 10 ppm in total, no improvement can be seen in the corrosion properties of the treated metallic components and only the conservation of considerable quantities of rinsing water can be recorded. Above a content of 20 ppm in total, based on the elements mentioned above, and in particular above 50 ppm in total, the anticorrosive effect achieved in the method according to the invention is considerably improved compared with a processing sequence which only carries out a cascading recirculation into the first postrinsing stage (E).

Again, it is preferred if the proportion of the elements B, Si, Ti, Zr and/or Hf in the form of water-soluble compounds in the prerinsing stage (C) amounts to no more than 20%, preferably no more than 10%, based on the proportion of the respective element in the conversion treatment stage (D), as otherwise the tendency towards sludge formation in the rinsing stage (C) is increased and has to be countered with additional technical measures, which would not be justified by any clear improvement in the corrosion protection and in the paint adhesion of the metallic components treated by the method according to the invention.

The content of active components consisting of the components of the aqueous composition (1) of the treatment stage (D) in the first postrinsing stage (E) is at least equally as high as the content of these active components in the final prerinsing stage (C) in the method according to the invention owing to the constant drag-over of conversion treatment solution by means of the treated metallic components and the simultaneous cascading recirculation of rinsing water from this postrinsing stage (E). Because the pH values in the final prerinsing stage (C) tend to be higher, the proportion of water-soluble compounds of the elements B, Si, Ti, Zr and/or Hf is usually somewhat lower than in the first postrinsing stage (E), however.

The pH values in the final prerinsing stage (C), which tend to be higher in comparison with the first postrinsing stage, are based on the drag-over of components of the cleaning and degreasing stage, which preferably consists of an alkaline cleaner system. Conversely, primarily components of the acidic aqueous composition (1) are dragged over into the first postrinsing stage (E).

For a more rapid and more effective anticorrosion conversion of the metal surface, the aqueous composition of the conversion treatment stage (D) contains preferably more than 100 ppm in total, particularly preferably more than 400 ppm in total, but preferably no more than 1500 ppm in total, particularly preferably no more than 1000 ppm in total of the elements B, Si, Ti, Zr and/or Hf in the form of water-soluble compounds.

The sludge formation, which owing to the recirculated rinsing water is also jointly caused by considerable quantities of iron ions and possibly also zinc and aluminum ions, which in turn pass into the treatment stage (D) by means of the pickling attack on the metallic component during the conversion treatment and from there are dragged over into the postrinsing stages, can also be largely suppressed in a preferred embodiment. To this end, it is preferred to carry out the cascaded recirculation of aqueous medium from the final rinsing stage to the first rinsing stage such that at least part of the medium which contains the elements B, Si, Ti, Zr and/or Hf in the form of water-soluble compounds and is to be recirculated from the postrinsing stage (E) into the prerinsing stage (C) is not directly returned and this part of the medium to be recirculated a) is adjusted to a pH value of greater than 5.0, preferably greater than 5.5,
b) any precipitate which is being formed is separated from the rinsing water, and
c) optionally the rinsing water, from which precipitate has been removed in step b), is subjected to either an ion exchange method or to reverse osmosis, and the rinsing water treated in this manner is likewise returned as part of the medium to be recirculated into the prerinsing stage (C).

The separation of insoluble metal hydroxides from the medium to be recirculated from the postrinsing stages permits a precise adjustment of the proportion of the elements B, Si, Ti, Zr and/or Hf in the form of water-soluble compounds in the prerinsing stage (C) in this manner.

In the method according to the invention, preferably aqueous compositions (1) with a proportion of fluorine bound in the form of fluoro complexes of the elements B, Si, Ti, Zr and/or Hf or in excess and unbound in the form of free fluoride are used in conversion treatment stage (D). A proportion of fluorine in excess and unbound in the form of free fluoride means that more fluoride ions are contained in the solutions than are needed for complexing the elements B, Si, Ti, Zr and/or Hf.

Through the use of fluorine-containing water-soluble compounds of the elements B, Si, Ti, Zr and/or Hf, an increased pickling attack is exerted on the metallic component, which results in a more rapid and more complete conversion of the metal surface.

If fluorine-containing aqueous compositions are used in the method according to the invention, certain pH ranges can be defined for the aqueous compositions of the prerinsing stage and the first postrinsing stage, for which there is adequate stability of the respective composition of the rinsing stage containing the elements B, Si, Ti, Zr and/or Hf in the form of water-soluble compounds and an optimum anticorrosion treatment of the metallic components.

Thus, in the prerinsing stage (C) preferably a pH range of 5.0 to 7.0, in particular of 5.8 to 6.2 is established, while in the postrinsing stage (E) this is preferably in the range of 4.0 and 5.5 and in particular in the range of 4.8 and 5.2.

Higher alkalinities in the rinsing stages cause either the precipitation of hydroxides of the heavy metals, which are dragged over into the rinsing stages during the treatment of the metallic component by the method according to the invention, for example iron, or lead to the active components in the form of the water-soluble compounds of the elements B, Si, Ti, Zr and/or Hf being partially or completely co-precipitated and thus no longer available in the method according to the invention.

In another preferred embodiment of the method, for the selective separation of iron ions from the fluorine-containing rinsing water to be recirculated, the cascaded recirculation of aqueous medium from the final rinsing stage into the first rinsing stage takes place such that at least part of the medium which contains the elements B, Si, Ti, Zr and/or Hf in the form of water-soluble compounds and is to be recirculated from the postrinsing stage (E) into the prerinsing stage (C) is not directly returned and this part of the medium to be recirculated a) is adjusted to a pH value of greater than 5.0, preferably greater than 5.5, with an alkaline solution which does not contain any calcium ions,
b) any precipitate which is being formed is separated from the rinsing water, and the rinsing water treated in this manner is likewise returned into the prerinsing stage (C) as part of the medium to be recirculated. This part of the medium to be recirculated no longer contains any iron ions, however, and so the sludge formation in the prerinsing stage (C) is largely suppressed. The proportion of the elements B, Si, Ti, Zr and/or Hf in the form of water-soluble compounds representing fluoro complexes, however, remains largely unaffected in the aqueous medium by this alkaline treatment. However, it should be ensured that the alkalinity of the part of the aqueous medium to be recirculated preferably does not lead to values outside the optimum pH range for the rinsing stage (C). Preferably, the pH value in stage a) of the selective separation of iron ions from the fluorine-containing rinsing water to be recirculated is adjusted to values of no greater than 8.0, preferably no greater 7.0 and particularly preferably no greater than 6.0.

In a particular embodiment of the method according to the invention with cascaded recirculation of rinsing water, the complete precipitation of the heavy metals and the active components from a part of the rinsing water to be recirculated into the prerinsing stage (C) which, as a result of drag-over from the conversion treatment stage (D), contains a proportion of fluorine bound in the form of fluoro complexes of the elements B, Si, Ti, Zr and/or Hf or in excess and unbound in the form of free fluoride, takes place with the aid of an aqueous solution of $Ca(OH)_2$. For this purpose, part of the medium to be recirculated from the postrinsing stage (E), which is not returned directly into the prerinsing stage (C), a) is combined with such a quantity of an aqueous solution of $Ca(OH)_2$, which contains no more than 0.1 wt. % undissolved $Ca(OH)_2$, that the pH value of the rinsing water rises to a value in the range from greater than 5.0, preferably greater than 5.5 and no greater than 7.0, b) any precipitate which is being formed is separated from the rinsing water, and the rinsing water treated in this manner is likewise then returned as part of the medium to be recirculated into the prerinsing stage (C).

A pH value of about 9 to about 11, as is conventional in a classic milk of lime precipitation according to the prior art, is therefore avoided in this method according to the invention. It has been demonstrated that, despite this low pH value in the range from 5.0 to 7.0 and the correspondingly small added amount of calcium hydroxide, heavy metals, such as iron ions, and the active components in the rinsing water comprising water-soluble fluoro complexes of the elements B, Si, Ti, Zr and/or Hf, preferably of the elements Ti and/or Zr and in particular Zr, largely settle out in a precipitate which is formed. The separation of the precipitated sludge from the rinsing water is possible with conventional techniques such as filtration or centrifugation and sedimentation methods. For example, sack filters or gravel filters may be used for this purpose. The rinsing water from which soluble heavy metal compounds and the active components have been removed in this manner can now optionally be subjected to a method which is known per se, which largely yields low salt-content or desalted water. This can be an ion exchange method or reverse osmosis, which are known as such in the prior art for the desalting of water.

Preferably, for the complete precipitation of the heavy metals and the active components, the part of the rinsing water from the postrinsing stage (E) to be recirculated which is not directly returned into the prerinsing stage (C) is combined in step a) with such a quantity of aqueous solution of $Ca(OH)_2$ that the change in the electrical conductivity of the part of the rinsing water to be recirculated amounts to no more than 200 μS/cm, preferably no more than 100 μS/cm. If this is the case, further desalting of the rinsing water may optionally be omitted or the conventional desalting methods are used economically.

It is likewise preferred that, for the complete precipitation of the heavy metals and the active components, the aqueous solution of $Ca(OH)_2$ in step a) contains 0.001 to 0.14 wt. % $Ca(OH)_2$. This concentration range is particularly favorable in pH-controlled automatic metering for maintaining the limits for pH value and electrical conductivity desired according to the invention in that part of the rinsing water to be recirculated from the postrinsing stage (E) which is not directly returned into the prerinsing stage (C).

By coordinating the respective proportions of the rinsing water to be recirculated which are returned directly or indirectly into the prerinsing stage (C), the complete separation of insoluble heavy metal hydroxides and active components from a part of the rinsing water to be recirculated from the postrinsing stages permits a precise adjustment of the proportion of the elements B, Si, Ti, Zr and/or Hf in the form of water-soluble compounds in prerinsing stage (C) to the preferred maximum values of no more than 20%, in particular no more than 10%, based on the proportion of the respective element in the conversion treatment stage (D).

In another aspect, the present invention relates to a metallic component which has been anticorrosion pretreated in a method according to one or more of the preceding claims and its use in a process for applying a multilayer system, in particular a paint system containing an organic binder in industrial manufacture. Such a metallic component is also suitable for the production of white goods, electronic housings, in the fields of construction and architecture and for the production of vehicle bodies in automotive manufacture.

EXEMPLARY EMBODIMENTS

To demonstrate the method according to the invention for the pretreatment of metal surfaces and the associated increase in corrosion protection, as well as the improvement in paint adhesion, steel sheets were treated on a laboratory scale in two process chains P1 and P2 with different compositions of the individual treatment stages, the process chains not being operated in cascaded manner and the drag-over of conversion treatment solution from step (D) being limited (Table 1). On completion of the pretreatment, the sheets were provided with an electrophoretic paint and investigated in terms of corrosion and paint adhesion.

The process chain P1 simulates a stationary state of the method according to the invention with cascading recirculation of rinsing water. In contrast, the process chain P2 simulates a stationary state of a first postrinsing stage (E) operated in overflow without cascading recirculation into the prerinsing stages, in which precisely as many active components are removed in the overflow per interval of time as are introduced per interval of time by drag-over, wherein the proportion of water-soluble compounds of the elements B, Si, Ti, Zr and/or Hf in the postrinsing stage (E) is negligible.

TABLE 1

Results of the test under changing climatic conditions in accordance with VDA 621-415 on steel and galvanized steel sheets

| | Composition of the treatment stage | |
|---|---|---|
| Stage | P1 | P2 |
| A | Alkaline degreasing: Ridoline 1574 (3%) and Ridosol 1270 (0.3%) in process water at pH = 10.5-11 for 300 seconds and T = 55° C.-60° C. | |
| B | Rinsing with process water at T = 20° C. for 90 seconds Conductivity 500-900 $\mu Scm^{-1}$ | |
| C | Deionized water with 10% content of the bath of stage D at pH = 6 for 90 seconds | Deionized water for 90 seconds Conductivity <100 $\mu Scm^{-1}$ |
| D | 750 ppm Zr as $H_2ZrF_6$ 20 ppm Cu as $CuNO_3$ 25 ppm Si as $SiO_2$ pH = 4 for 90 seconds | |
| E* | Deionized water with 10% content of the bath of stage D at pH = 5 for 90 seconds | Deionized water for 90 seconds Conductivity <200 $\mu Scm^{-1}$ |
| F | Deionized water for 90 seconds Conductivity <50 $\mu Scm^{-1}$ | |
| G | Electrophoretic painting: Cathoguard ® 500 (BASF), paint coat thickness 18 μm-22 μm | |

*Every 25 sheets (approx. 1 $m^2$ treated metal surface), the treatment stage (E) was prepared afresh It can now be seen from Table 2 that, with cascading recirculation of rinsing water containing active components of the conversion treatment, no deterioration of the corrosion protection and paint adhesion results in the method according to the invention (E1-E4). Such a deterioration was expected, however, since the mere extension of the improved treatment period with a conversion solution leads to the fact that, although higher coat weights result based on the elements B, Si, Ti, Zr and/or Hf, the metallic components generally exhibit coat defects owing to excessive etching in the conversion treatment solution, which in turn reduce the corrosion resistance. The same would be expected for the method according to the invention, since both in the prerinsing stage (C) and in the postrinsing stage (E), considerable quantities of active components are contained, for example approx. 75 ppm Zr in the form of $H_2ZrF_6$ (cf. Table 1, P1).

Surprisingly, it is also shown that both the corrosion protection and the paint adhesion are clearly improved in a method according to the invention, especially on steel and aluminum surfaces, compared with a method without any active components in the pre- and postrinsing (Tables 2 and 3).

TABLE 2

Results of the test under changing climatic conditions in accordance with VDA 621-415 on steel and galvanized steel sheets

| No. | Substrate | Corrosion* U/2 in mm | Detachment* U/2 in mm | Stone chip# K value [0-5] |
|---|---|---|---|---|
| C1 | CRS | 2.8 | 2.9 | 5 |
| E1 | CRS | 1.0 | 1.0 | 2.5 |
| C2 | EG | 3.2 | 3.2 | 3.5 |
| E2 | EG | 3.1 | 3.1 | 4 |
| C3 | HDG | 3.7 | 3.7 | 4.5 |
| E3 | HDG | 4.0 | 4.0 | 4.5 |

Scribe tool: Clemens; evaluation of VDA test after 70 days
*according to DIN EN ISO 4628-8
#according to DIN EN ISO 20567-1

The particularly marked improvement of the anticorrosion results on steel, together with a high level of water conservation also present in the method according to the invention with cascading recirculation, shows to a particular extent the advantages of the method on which the invention is based.

TABLE 3

Filiform corrosion results in accordance with DIN EN 3665 on aluminum sheets (averages of 5 individual measurements)

| No. | Substrate | Longest thread+ [mm] | Creep corrosion++ [mm] |
|---|---|---|---|
| C4 | Al 6016 GB | 6.2 | 1.4 |
| E4 | Al 6016 GB | 4.0 | 1.0 |

Scribe tool: Sikkens; evaluation by Daimler Chrysler method PAPP PWT 3002
+5 mm at each end of the scratch track were not taken into account;
++after 42 days

What is claimed is:

1. A method for anticorrosion pretreatment of metal surfaces in a processing sequence comprising a conversion treatment stage (D) with an aqueous composition (1) containing in total at least 50 ppm of one or more of elements B, Si, Ti, Zr and Hf in the form of water-soluble compounds at a pH value of 3 to 5.5, wherein the metallic surfaces pass in succession through at least treatment stages of:

(A) optionally degreasing and cleaning;

(B) optionally rinsing with process water optionally containing part of the aqueous composition of the degreasing and cleaning stage (A);

(C) prerinsing with water containing in total at least 10 ppm of elements B, Si, Ti, Zr and/or Hf in the form of water-soluble compounds;

(D) conversion treatment with the aqueous composition (1);

(E) postrinsing with water containing part of the aqueous composition (1) of treatment stage (D);

(F) optionally second postrinsing with water containing part of the aqueous composition of postrinsing stage (E), wherein the aqueous composition (1) of the conversion treatment stage (D) contains a proportion of fluorine bound in the form of fluoro complexes of the one or more elements B, Si, Ti, Zr and Hf or fluorine in excess and unbound in the form of free fluoride, and wherein pH value in the prerinsing stage (C) is in a range from 5 to 7.0, and wherein a cascaded recirculation of aqueous medium from the final rinsing stage to the first rinsing stage proceeds such that in total at least 10 ppm of the elements B, Si, Ti, Zr and/or Hf in the form of water-soluble compounds are present in the prerinsing stage (C).

2. The method as claimed in claim 1, wherein in total at least 20 ppm of the elements B, Si, Ti, Zr and/or Hf are present in the prerinsing stage (C) in the form of water-soluble compounds.

3. The method as claimed in claim 1, wherein the proportion of the elements B, Si, Ti, Zr and/or Hf in the form of water-soluble compounds in the prerinsing stage (C) amounts to no more than 20%, relative to the proportion of the respective element in the conversion treatment stage (D).

4. The method as claimed in claim 1, wherein the pH value in the prerinsing stage (C) is in a range from 5.8 to 6.2.

5. The method as claimed in claim 1, wherein the pH value in the postrinsing stage (E) is in a range from 4.0 to 5.5.

6. The method as claimed in claim 1, wherein the metallic surfaces pass in succession through the following treatment stages:

(A) optionally degreasing and cleaning (B) optionally rinsing with process water optionally containing part of the aqueous composition of the degreasing and cleaning stage (A)

(C) prerinsing with water containing in total at least 10 ppm of the elements B, Si, Ti, Zr and/or Hf in the form of water-soluble compounds and optionally part of the aqueous composition of rinsing stage (B)

(D) conversion treatment with the aqueous composition (1) containing part of the aqueous composition of prerinsing stage (C)

(E) first postrinsing with water containing part of the aqueous composition of treatment stage (D)

(F) optionally second postrinsing with water containing part of the aqueous composition of postrinsing stage (E), wherein the final rinsing stage is supplied with deionized water.

7. The method as claimed in claim 6, wherein the cascaded recirculation of aqueous medium from the final rinsing stage to the first rinsing stage proceeds such that at least part of the medium which contains the elements B, Si, Ti, Zr and/or Hf in the form of water-soluble compounds and is to be recirculated from the postrinsing stage (E) into the prerinsing stage (C) is not directly returned and this part of the medium to be recirculated a) is adjusted to a pH value of greater than 5.0, b) any precipitate which is being formed is separated from the rinsing water, and c) optionally the rinsing water, from which precipitate has been removed in step b), is subjected to either an ion exchange method or to reverse osmosis, and the rinsing water treated in this manner is likewise returned as part of the medium to be recirculated into the prerinsing stage (C).

8. The method as claimed in claim 7, wherein the aqueous composition (1) of treatment stage (D) contains a proportion of fluorine bound in the form of fluoro complexes of the one or more of elements B, Si, Ti, Zr and Hf or in excess and unbound in the form of free fluoride, wherein the part of the medium to be recirculated from the postrinsing stage (E) which is not directly returned to the prerinsing stage (C) is adjusted in step a) with an alkaline solution which contains no calcium ions to a pH value of greater than 5.0, then any precipitate which is being formed is separated from the rinsing water and the rinsing water treated in this manner is returned as part of the medium to be recirculated into the prerinsing stage (C).

9. The method as claimed in claim 7, wherein the aqueous composition (1) of treatment stage (D) contains a proportion of fluorine bound in the form of fluoro complexes of the one or more of elements B, Si, Ti, Zr and Hf or in excess and unbound in the form of free fluoride, wherein the part of the medium to be recirculated from the postrinsing stage (E) which is not directly returned to the prerinsing stage (C) is combined in step a) with such a quantity of an aqueous solution of $Ca(OH)_2$, which contains no more than 0.1 wt. % of undissolved $Ca(OH)_2$, that the pH value of the rinsing water rises to a value in a range from greater than 5.0 to no greater than 7.0.

10. The method as claimed in claim 6, wherein the cascaded recirculation of aqueous medium from the final rinsing stage to the first rinsing stage proceeds continuously and at a constant volumetric flow rate.

11. The method as claimed in claim 6, wherein the metallic surfaces are at least in part surfaces of iron and/or steel.

12. A metallic component which has been anticorrosion pretreated according to the method as claimed in claim 6.

13. A process for applying a multilayer system in industrial manufacture wherein the metallic component of claim 12 comprises a substrate in said process.

14. An article of manufacture comprising the metallic component as claimed in claim 12.

15. The method as claimed in claim 6, wherein the cascaded recirculation of aqueous medium from the final rinsing stage to the first rinsing stage proceeds such that in total at least 20 ppm of the elements B, Si, Ti, Zr and/or Hf are present in the prerinsing stage (C);

the proportion of the elements B, Si, Ti, Zr and/or Hf in the form of water-soluble compounds in the prerinsing stage (C) amounts to no more than 20%, relative to the proportion of the respective element in the conversion treatment stage (D);

pH of the postrinsing stage (E) is in a range from 4.0 to 5.5; and content of components of the aqueous composition (1) of the treatment stage (D) in the first postrinsing stage (E) is at least equally as high as the content of these components in the final prerinsing stage (C).

16. A method for the anticorrosion pretreatment of metal surfaces in a processing sequence comprising a conversion treatment stage (D) with an aqueous composition (1) containing in total at least 50 ppm of the elements B, Si, Ti, Zr and Hf in the form of water-soluble compounds at a pH value of 3 to 5.5, wherein the metallic surface passes in succession through at least the following treatment stages of:

(A) optionally degreasing and cleaning;

(B) optionally rinsing with process water optionally containing part of the aqueous composition of the degreasing and cleaning stage (A);

(C) prerinsing with water containing in total at least 10 ppm of the elements B, Si, Ti, Zr and/or Hf in the form of water-soluble compounds;

(D) conversion treatment with the aqueous composition (1);

(E) postrinsing with water containing part of the aqueous composition (1) of treatment stage (D); and (F) optionally second postrinsing with water containing part of the aqueous composition of postrinsing stage (E), wherein the aqueous composition (1) of the conversion treatment stage (D) contains a proportion of fluorine bound in the form of fluoro complexes of the elements B, Si, Ti, Zr and/or Hf or fluorine in excess and unbound in the form of free fluoride and wherein the pH value in the prerinsing stage (C) is in a range from 5 to 7.0; and wherein the final rinsing stage is supplied with deionized water and a cascaded recirculation of aqueous medium from the final rinsing stage to the first rinsing state proceeds such that in total at least 10 ppm of the elements B, Si, Ti, Zr and/or Hf in the form of water-soluble compounds are present in the prerinsing stage (C), the treatment stage (D) being excepted from the cascaded recirculation and aqueous medium not being fed indirectly and directly into the treatment stage (D) from the final rinsing stage.

17. The method as claimed in claim 16, wherein the metallic surface passes in succession through the following treatment stages:

(A) degreasing and cleaning;

(B) rinsing with process water optionally containing part of the aqueous composition of the degreasing and cleaning stage (A);

(C) prerinsing with water containing in total at least 10 ppm of the elements B, Si, Ti, Zr and/or Hf in the form of water-soluble compounds and optionally part of the aqueous composition of rinsing stage (B);

(D) conversion treatment with the aqueous composition (1) containing part of the aqueous composition of prerinsing stage (C);

(E) first postrinsing with water containing part of the aqueous composition of treatment stage (D);

(F) second postrinsing with water containing part of the aqueous composition of postrinsing stage (E).

* * * * *